US008485913B2

(12) United States Patent
Antolick

(10) Patent No.: US 8,485,913 B2
(45) **Date of Patent: *Jul. 16, 2013**

(54) ENHANCED WEARABLE SWING TRAINING APPARATUS

(76) Inventor: Jeffrey B. Antolick, Drums, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/470,532

(22) Filed: May 14, 2012

(65) Prior Publication Data

US 2012/0225741 A1 Sep. 6, 2012

Related U.S. Application Data

(63) Continuation-in-part of application No. 12/795,453, filed on Jun. 7, 2010, now Pat. No. 8,177,653.

(60) Provisional application No. 61/185,071, filed on Jun. 8, 2009.

(51) Int. Cl.
*A63B 69/36* (2006.01)
*A63B 69/00* (2006.01)

(52) U.S. Cl.
USPC ..... 473/217; 473/452; 473/458

(58) Field of Classification Search
USPC ..... 473/217, 266, 270, 272, 278, 452, 473/458
See application file for complete search history.

(56) References Cited

U.S. PATENT DOCUMENTS

| | | | | |
|---|---|---|---|---|
| 5,810,673 | A * | 9/1998 | Castleberry | 473/217 |
| 7,918,477 | B2 * | 4/2011 | Wischhusen et al. | 280/618 |
| 8,177,653 | B2 * | 5/2012 | Antolick | 473/217 |
| 2003/0224882 | A1 * | 12/2003 | Mahoney | 473/452 |
| 2007/0013165 | A1 * | 1/2007 | Panzeri | 280/618 |

* cited by examiner

*Primary Examiner* — Nini Legesse
(74) *Attorney, Agent, or Firm* — John R. Kasha; Kelly L. Kasha; Kasha Law LLC

(57) ABSTRACT

A swing training apparatus includes a rotation mechanism and a wearable shoe attachment device. The rotation mechanism includes a first plate connected to a second plate so that the first plate rotates with respect to the second plate about a shared plate axis of rotation. The wearable shoe attachment device is connected to the first plate. The wearable shoe attachment device positions a shoe of an athlete so that as the athlete rotates a foot and the shoe enclosing the foot with respect to a part of the foot and about a foot axis of rotation, the foot axis of rotation and the plate axis of rotation coincide. The wearable shoe attachment device connects to the first plate so that the swing training apparatus moves with the foot while walking or running. The wearable shoe attachment device includes three straps that secure a shoe snuggly to the rotation mechanism.

20 Claims, 9 Drawing Sheets

900

ENHANCED WEARABLE SWING TRAINING APPARATUS

CROSS-REFERENCE TO RELATED APPLICATIONS

This application is a continuation-in-part application of U.S. Ser. No. 12/795,453, filed Jun. 7, 2010 now U.S. Pat. No. 8,177,653, and claims the benefit of U.S. Provisional Patent Application No. 61/185,071, filed Jun. 8, 2009.

INTRODUCTION

Back foot lockout is one of the most common problems facing many baseball players and golfers, which is typically not addressed by instructors and coaches. Back foot lockout occurs when the athlete fails to properly rotate their back foot during the course of their swing. This improper rotation of the back foot creates an improper rotation of the athlete's hip or, in some circumstances, no rotation of the athlete's hip. In the prior art various types of swing trainers have been proposed. These swing training devices have included an upper and lower plate that rotate with respect to each other and allow a user to rotate their back foot while swinging a club or bat. These devices are generally not portable and are only useful under strict training conditions.

BRIEF DESCRIPTION OF THE DRAWINGS

The skilled artisan will understand that the drawings, described below, are for illustration purposes only. The drawings are not intended to limit the scope of the present teachings in any way.

Figure 1:
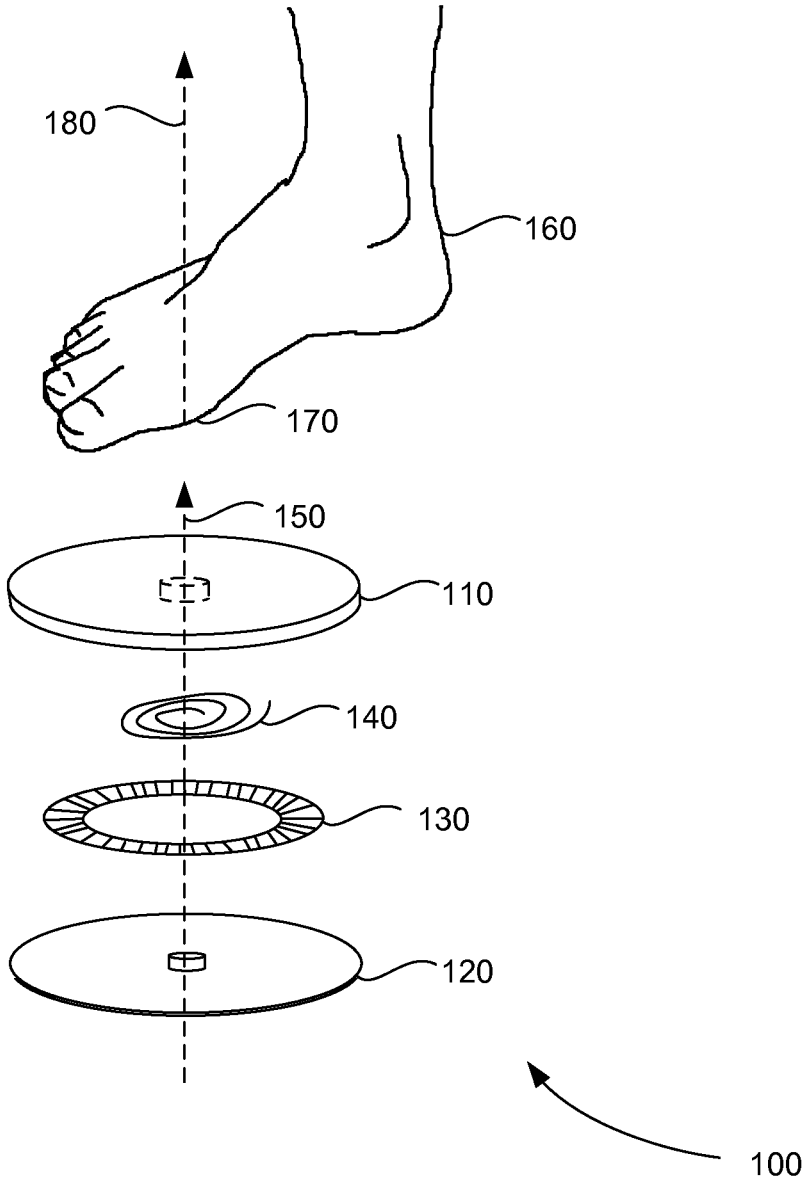
FIG. 1 is an exploded view of a swing training apparatus, in accordance with various embodiments.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

As described above, back foot lockout occurs when an athlete fails to properly rotate their back foot during the course of a swinging motion. The swinging motion may be performed in sports including, but not limited to, baseball, softball, golf, cricket, lacrosse, or field hockey. Back foot lockout, in turn, can result in little or no hip rotation during a swing. As a result, the proper rotation of the back foot during a swing is an important part of good swing mechanics.

In various embodiments, a wearable swing training apparatus allows an athlete to more easily rotate their back foot under realistic playing conditions. The apparatus includes a first plate and a second plate. The first plate is positioned above the second plate, and is attached to the second plate so that it can rotate with respect to the second plate. The first plate and the second plate are attached by way of a movable joint that can include, but is not limited to including, bearings, self lubricating plastic, acrylic, rubber, or any other durable and wearable substance. The movable joint can be enclosed to avoid debris from entering the joint. The movable joint is enclosed by an o-ring, for example.

The first plate is also attached to the shoe of the back foot of an athlete. The shoe can include, but is not limited to, a sneaker, a cleat, a training shoe, a playing shoe, a golf shoe, or any other type of shoe. The first plate is attached to the shoe so that the back foot can rotate with respect to a part of the foot.

For a baseball swing, for example, the athlete may want to learn how to rotate their back foot with the axis of rotation centered near the ball of the foot. As a result, in various embodiments, the first plate is attached to the shoe so that the axis of rotation of the first plate corresponds to or coincides with the axis of rotation of the ball of the back foot of the athlete.

Alternatively, for a golf swing, for example, the athlete may want to learn how to rotate their back foot with the axis of rotation centered near the toes of the foot. As a result, in various embodiments, the first plate is attached to the shoe so that the axis of rotation of the first plate coincides with the axis of rotation of the toes of the back foot of the athlete.

In various embodiments, the attachment of the first plate to the shoe is adjustable. An adjustable attachment allows the axis of rotation of the back foot of the athlete to be centered with respect to any part of the back foot.

The first plate is attached to the shoe using a wearable shoe attachment device, for example. The wearable shoe attachment device can include one or more straps that can be made of material that includes, but is not limited to including, rubber, canvas, Velcro, leather, shoe laces, metal, plastic, acrylic, netting, cloth, or any other wearable substance. The one or more straps are connected to the first plate and surround a portion of the shoe to secure the shoe to the first plate. The one or more straps also position the shoe with respect to the first plate so that the desired axis of rotation of the shoe and the back foot coincides with the axis of rotation of the first plate. The wearable shoe attachment device can also include a heel connected to the one or more straps. Because the first plate and the second plate have a thickness, a heel can be used to properly level the shoe in the swing training apparatus.

In various embodiments, the first plate is directly connected to the shoe. The shoe can be designed specifically for connection to the swing training apparatus, for example. The first plate can be connected to the shoe by means of a screw-type device, clips, knobs, snaps, or any other means of quickly and easily attaching or detaching the first plate to the shoe. The direct connection of the first plate to the shoe also positions the shoe with respect to the first plate so that the desired axis of rotation of the shoe and the back foot coincides with the axis of rotation of the first plate.

The attachment of the first plate to the shoe makes the swing training apparatus wearable. This means that the apparatus can be moved with any foot movement, including, but not limited to, walking or running. This allows the apparatus to be used in any environment, including, but not limited to, a training environment or the actual field of play. Baseball or softball players can move into and out of a batter's box during batting practice wearing the apparatus, for example The surfaces of these environments can vary significantly, however. Since the second plate of the swing training apparatus must remain fixed as the first plate rotates, the second plate has to make good contact with the surface of a training or playing environment.

In various embodiments, a swing training apparatus includes a removable third plate connected to the second plate. The third plate can be connected to the second plate by means of a screw-type device, clips, knobs, snaps, or any other means of quickly and easily attaching or detaching the third plate to or from the second plate. On the side not connected to the second plate, the third plate has a surface designed to provide good grip to the training or playing environment surface. The third plate can have various surfaces that include, but are not limited to including, plastic spikes, metal spikes, rubber spikes, rubber pad, rubber knobs, plastic knobs, turf, or any other substance that allows the third plate to rest comfortably, safely and securely on a training or playing surface.

The proper rotation of the back foot during a swing is, for example, ninety degrees. A rotation beyond ninety degrees would not improve swing mechanics. In fact, a rotation beyond ninety degrees can potentially result in injury. Also, a rotation to ninety degrees or some other angle that is limited by a hard stop may potentially result in injury.

In various embodiments, the attachment of the first plate to the second plate includes a mechanism to increase angular resistance as the angle between the two plates increases to ninety degrees. This angular resistance can be linear, for example. In various embodiments, this angular resistance can be nonlinear. The mechanism to increase angular resistance between the first plate and the second plate can include, but is not limited to including, rubber bands, springs, tension screws, friction devices, an electronic mechanism, stop guards, or any other mechanism capable of increasing angular resistance. The mechanism to increase angular resistance may be located outside of the first plate and the second plate, or it may be located inside of or enclosed in the first plate, the second plate, or both. The angular resistance mechanism increases the angular resistance and slows down the motion of first plate with respect to the second plate as it rotating, so that the angle of rotation is limited and the potential for injury is reduced. The mechanism can also reset the angle of rotation between the two plates back to near zero degrees when the second plate is released from the training or playing surface.

In various embodiments, the angular resistance mechanism is adjustable in order to change the direction of angular resistance. For example, left handed and right handed batters or golfers rotate their back feet in different directions. As a result, the direction of the of the angular resistance between the first plate the second plate must change for left handed and right handed batters.

Increasing the angular resistance between the first plate and the second plate as the angle between the two plates increases to ninety degrees gives the athlete some indication of whether or not they are properly rotating their back foot. However, in the midst of concentrating on batting a moving ball or launching a ball from a tee, this type of feedback may not be noticeable to the athlete. This type of feedback is also no noticeable to an instructor or coach.

In various embodiments, a swing training apparatus includes an audible feedback mechanism that provides an indication of the angle of rotation between the first plate and the second plate. The audible feedback mechanism can provide audible clicks or tones as the angle of rotation between the first plate and the second plate increases or reaches certain angles. The audible feedback mechanism is, for example, a toothed cog that comes in contact with a paddle at certain angles and provides a clicking sound. The tooth cog and paddle can be part of the first plate, the second plate, or both. In various embodiments, the audible feedback mechanism includes an electronic circuit that measures the angle of rotation and emits tones through a speaker at certain angles.

An audible feedback mechanism can provide an athlete with some indication of whether or not they are properly rotating their back foot. However, this type of feedback may not be apparent to a coach. The coach may be too far away to hear the clicks or tones emitted by the swing training apparatus.

In various embodiments, a swing training apparatus includes a visual feedback mechanism that provides an indication of the angle of rotation between the first plate and the second plate. The visual feedback mechanism can provide flashes of light as the angle of rotation between the first plate and the second plate increases or reaches certain angles. The visual feedback mechanism includes an electronic circuit that measures the angle of rotation and emits flashes of light using a light emitting diode (LED), for example, at certain angles.

Audible or visual feedback mechanisms can significantly improve the usefulness of a swing training apparatus by giving an athlete or coach immediate information about the athlete's performance. However, good swing mechanics are generally learned over a vast number of repetitions. As a result, an improvement can sometimes only be seen after analyzing a large amount of information.

In various embodiments, a swing training apparatus includes an electronic circuit and a memory that records rotations between the first plate and the second plate over time. The electronic circuit measures the angle of rotation between the first plate and the second plate and stores each rotation that starts near zero degrees and increases to some angle above a threshold angle, for example. The electronic circuit includes an input/output port that allows the stored information to be transferred to an external memory, such as a universal serial bus (USB) memory stick. The information can then be analyzed using an external computer, for example. The memory of the swing training apparatus can be cleared or reset after each training session.

Consider, for example, an athlete who uses a swing training apparatus that includes a memory and takes batting practice. After batting practice the information about the swing training apparatus can be downloaded from the swing training apparatus. Suppose it is known that the athlete made thirty swings during batting practice. These thirty swings can be compared to the number of rotations near ninety degrees recorded by the swing training apparatus. Improvement is found if over many batting practices the number of rotations near ninety degrees approaches the number of swings.

FIG. 1 is an exploded view of a swing training apparatus 100, in accordance with various embodiments. Apparatus 100 includes first plate 110, second plate 120, movable joint 130, and angular resistance mechanism 140. Movable joint 130 is, for example, a bearing. Angular resistance mechanism 140 is, for example, a coiled spring. Movable joint 130 connects first plate 110 to second plate 120 so that first plate 110 can rotate with respect to second plate 120 and about shared plate axis of rotation 150. Angular resistance mechanism 140 is connected between first plate 110 and second plate 120. Angular resistance mechanism 140 increases the angular resistance between first plate 110 and second plate 120 as the angle of rotation about plate axis of rotation 150 is increased. A shoe (not shown) of an athlete contacts the first plate so that, as the athlete rotates foot 160 and the shoe enclosing the foot with respect to a part of the foot and about foot axis of rotation 180, foot axis of rotation 180 and plate axis of rotation 150 coincide. The athlete rotates foot 160 and the shoe enclosing the foot with respect to ball 170 of foot 160, for example.

Figure 2:
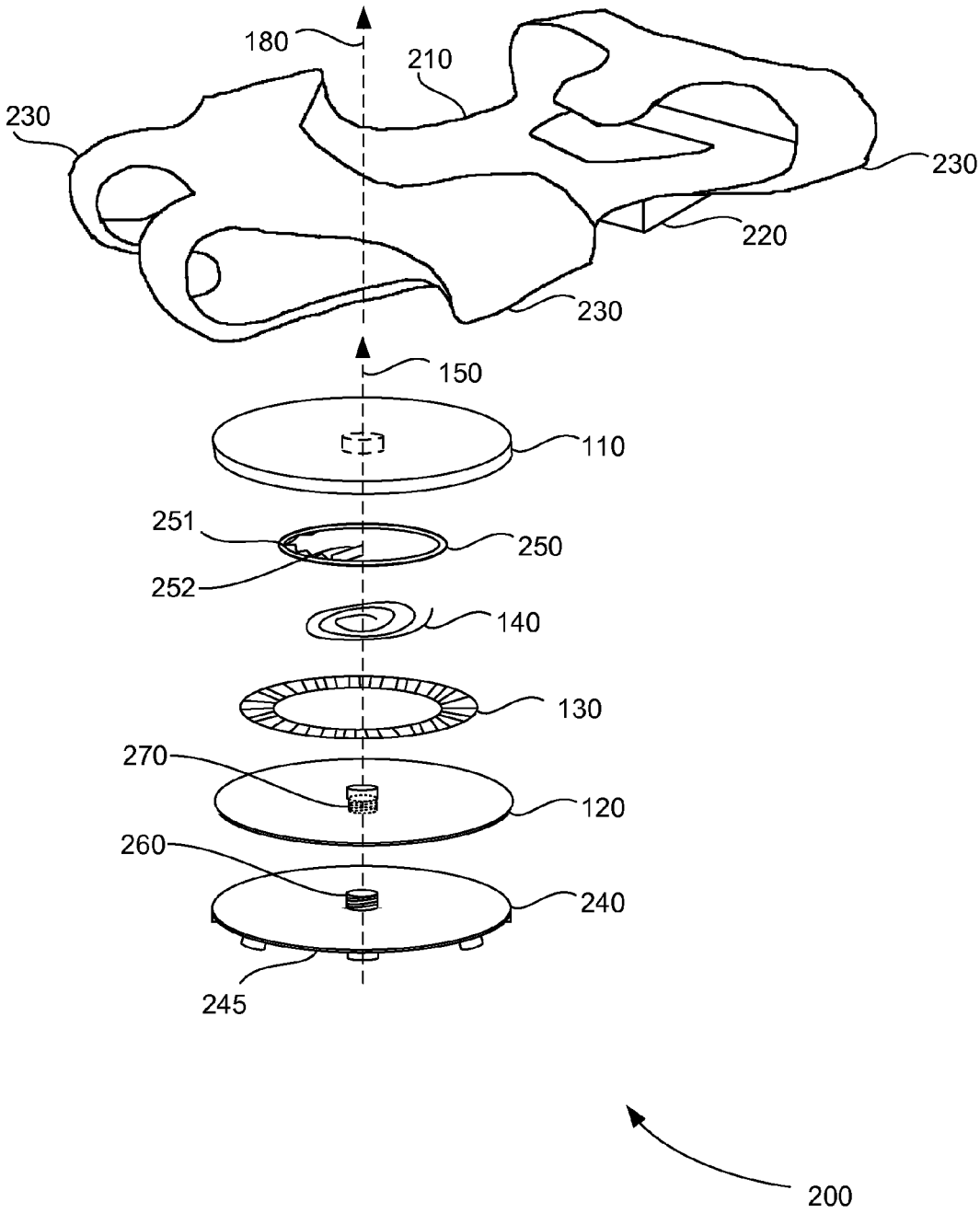
FIG. 2 is an exploded view of a swing training apparatus that includes a wearable shoe attachment device, in accordance with various embodiments.

FIG. 2 is an exploded view of a swing training apparatus 200 that includes wearable shoe attachment device 210, in accordance with various embodiments. In addition to wearable shoe attachment device 210, swing training apparatus 200 includes first plate 110, second plate 120, movable joint 130, and angular resistance mechanism 140, which are described above. Wearable shoe attachment device 210 is connected to first plate 110 and positions a shoe (not shown) of an athlete so that, as the athlete rotates a foot (not shown) and the shoe enclosing the foot with respect to a part of the foot and about foot axis of rotation 180, foot axis of rotation 180 and plate axis of rotation 150 coincide. Wearable shoe attachment device 210 is connected to first plate 110 permanently, for example.

In various embodiments, wearable shoe attachment device 210 can include heel 220. Heel 220 can be used to properly level the shoe secured by wearable shoe attachment device 210. In various embodiments, wearable shoe attachment device 210 includes one or more straps 230 that surround a portion of the shoe to secure the shoe to first plate 110.

In various embodiments, swing training apparatus 200 can include removable third plate 240 connected to second plate 120 that includes a surface 245 adapted to grip a playing or training surface. Surface 245 is, for example, a spiked surface. Removable third plate 240 connects to the second plate 120, for example, using screw 260 of removable third plate 240 and socket 270 of second plate 120.

In various embodiments, swing training apparatus 200 can include audio feedback mechanism 250. Audio feedback mechanism 250 includes toothed cog 251 and paddle 252, for example.

Figure 3:
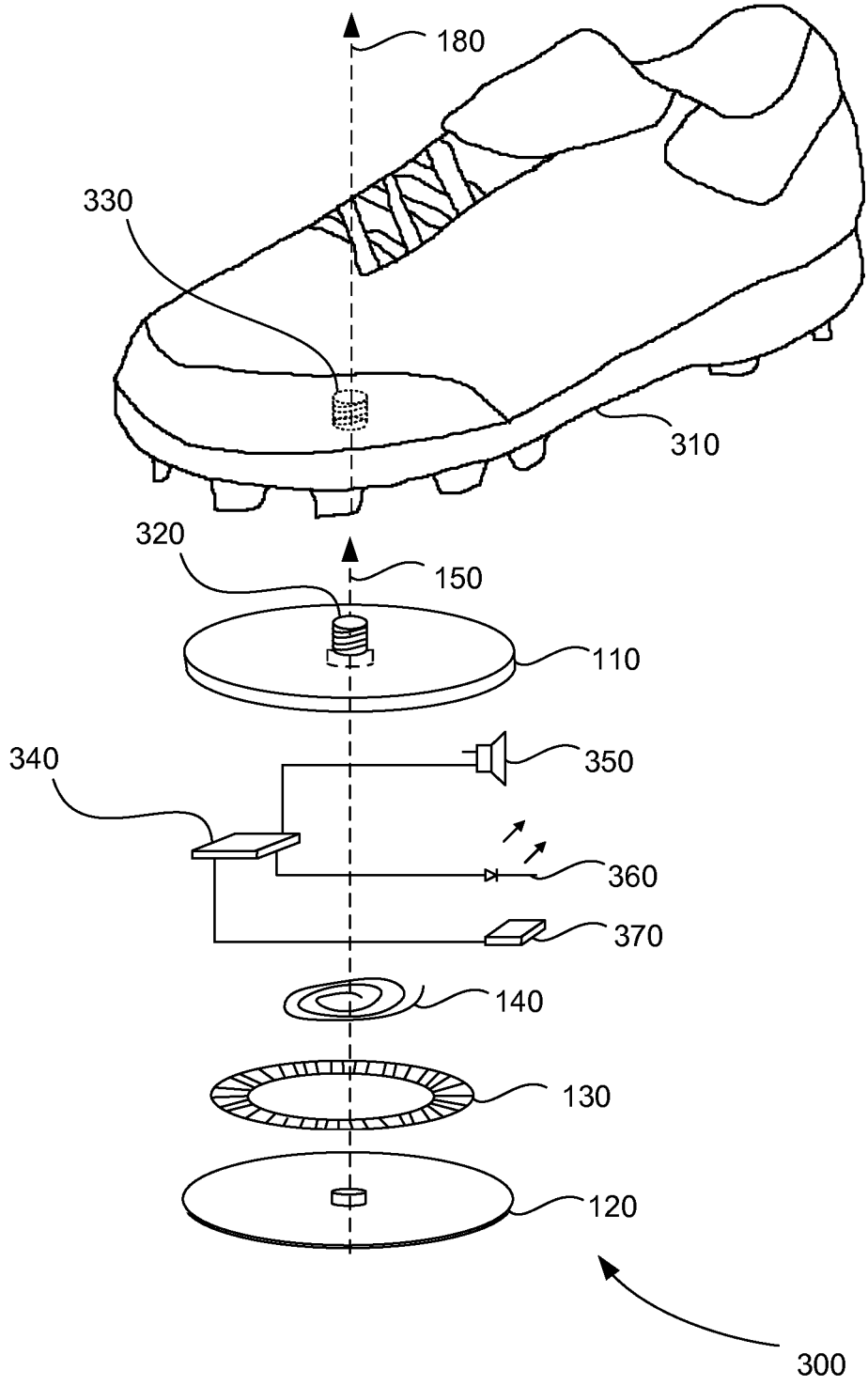
FIG. 3 is an exploded view of a swing training apparatus that includes a shoe adapted to connect to the swing training apparatus, in accordance with various embodiments.

FIG. 3 is an exploded view of a swing training apparatus 300 that includes a shoe 310 adapted to connect to swing training apparatus 300, in accordance with various embodiments. In addition to shoe 310, swing training apparatus 300 includes first plate 110, second plate 120, movable joint 130, and angular resistance mechanism 140, which are described above. Shoe 310 connects to the first plate 110 so that, as the athlete rotates a foot (not shown) and shoe 310 enclosing the foot with respect to a part of the foot and about foot axis of rotation 180, foot axis of rotation 180 and the plate axis of rotation 150 coincide. Shoe 310 connects to the first plate 110, for example, using screw 320 of first plate 110 and socket 330 of shoe 310.

In various embodiments, swing training apparatus 300 can include electronic circuit 340. Electronic circuit 340 can measure the angle of rotation between first plate 110 and second plate 120. In various embodiments, an audio feedback mechanism can include electronic circuit 340 and speaker 350. In various embodiments, a visual feedback mechanism can include electronic circuit 340 and LED 360. In various embodiments, electronic circuit 340 and memory 370 can be used to record one or more rotations between the first plate and the second plate over time.

Enhanced Wearable Swing Training Apparatus

In various embodiments, an enhanced wearable swing training apparatus includes a shoe attachment device that secures a rotation mechanism to a shoe in a fashion that can accommodate multiple shoe sizes. The shoe attachment device also secures rotation mechanism to the shoe so that the swing training apparatus moves with the foot while walking or running. A user can, for example, move into and out of a batter's box without have to remove the enhanced wearable swing training apparatus.

In various embodiments, the shoe attachment device includes three straps. A first strap secures the ball of the foot to the first plate. The first strap is opened, closed, and tightened using Velcro, for example. The first strap attaches to a first plate of the rotation mechanism on either side of the shoe and goes across the top of the shoe in a manner perpendicular to the shoe. The first strap is attached to the first plate so that the edge of the first strap closest to the heel of the shoe intersects or comes close to intersecting the axis of rotation of the rotation mechanism. If the edge of the strap closest to the heel of the foot were to go back too far towards the instep of the foot, the rotation of the foot would pull the second plate off of the ground.

A second strap attaches to the first strap on either side of the shoe. The second goes around the heel of the shoe. The second strap is also opened, closed, and tightened using Velcro, for example. The second strap preferably includes some portion of elastic material. The portion of the elastic material is 5 inches, for example. As the foot pivots and the heel of the shoe rises up, the elastic portion of the second strap prevents any gapping in the second strap and maintains a secure fit to the shoe.

A third strap attaches to the first plate attaches on one end to the first plate near the toe of the shoe and to the center of the first strap in a manner parallel to the shoe. The third strap is also opened, closed, and tightened using Velcro, for example. The third strap rises over the front portion of the foot and prevents the shoe from sliding forward as the foot is rotated or pivoted. In other words, securing the third strap tightly prevents the shoe from sliding over the front of the first plate.

In various embodiments, an enhanced wearable swing training apparatus provides dual feedback to a user. The enhanced wearable swing training apparatus provides both visual and audio feedback. Visual feedback is provided, for example, by providing an arrow symbol on the third strap of the shoe attachment device. The arrow provides feedback on the direction the back foot is pointing. For example, a user can look at the arrow after a swing to determine if the foot was rotated to the proper angle.

In various embodiments, audio feedback is provided by a clicking mechanism of the rotation mechanism of the enhanced wearable swing training apparatus. The rotation mechanism includes a first plate and a second plate. The first plate and the second plate are connected so that the first plate can rotate with respect to the second plate around an axis. The bottom portion of the first plate includes one or more flexible clickers or paddles. These one or more flexible clickers engage teeth located inside the edge of the second plate. As the first plate rotates with respect to the second plate, the one or more clickers of the first plate rise and fall in the teeth of the second plate creating a clicking sound. The user can determine the angle of rotation by the number of clicks, and the speed of the rotation by the rate of the clicks.

In various embodiments, the enhanced swing training can include a stopping mechanism that limits the rotation on the first plate with respect to the second plate to a specific angle. The stopping mechanism can be, for example, a notch or physical stop in the axis or post connecting the first plate to the second plate. The stopping mechanism can be adjustable or fixed. An adjustable stopping mechanism can be a movable stop in the first or second plate of the rotation mechanism that limits the rotation of the first plate with respect to the second plate to a specific angle.

A fixed mechanism can also be built into the first plate or the second plate. If the fixed mechanism is built into the second plate, the angle can be changed by changing the second plate. For example, a user may exchange a second plate with a 90 degree stopping mechanism for a second plate with a 45 degree stopping mechanism if the user wants to limit the rotation of the back foot to 45 degrees. A right handed hitter who hits the ball to left field with a 90 degree stopping mechanism can use a second plate with a 45 degree stopping mechanism to learn how to hit the ball to center or right field, for example.

An adjustable or fixed stopping mechanism can also include a spring. The spring allows the device to be reset automatically after each swing by simply lifting the foot.

Figure 4:
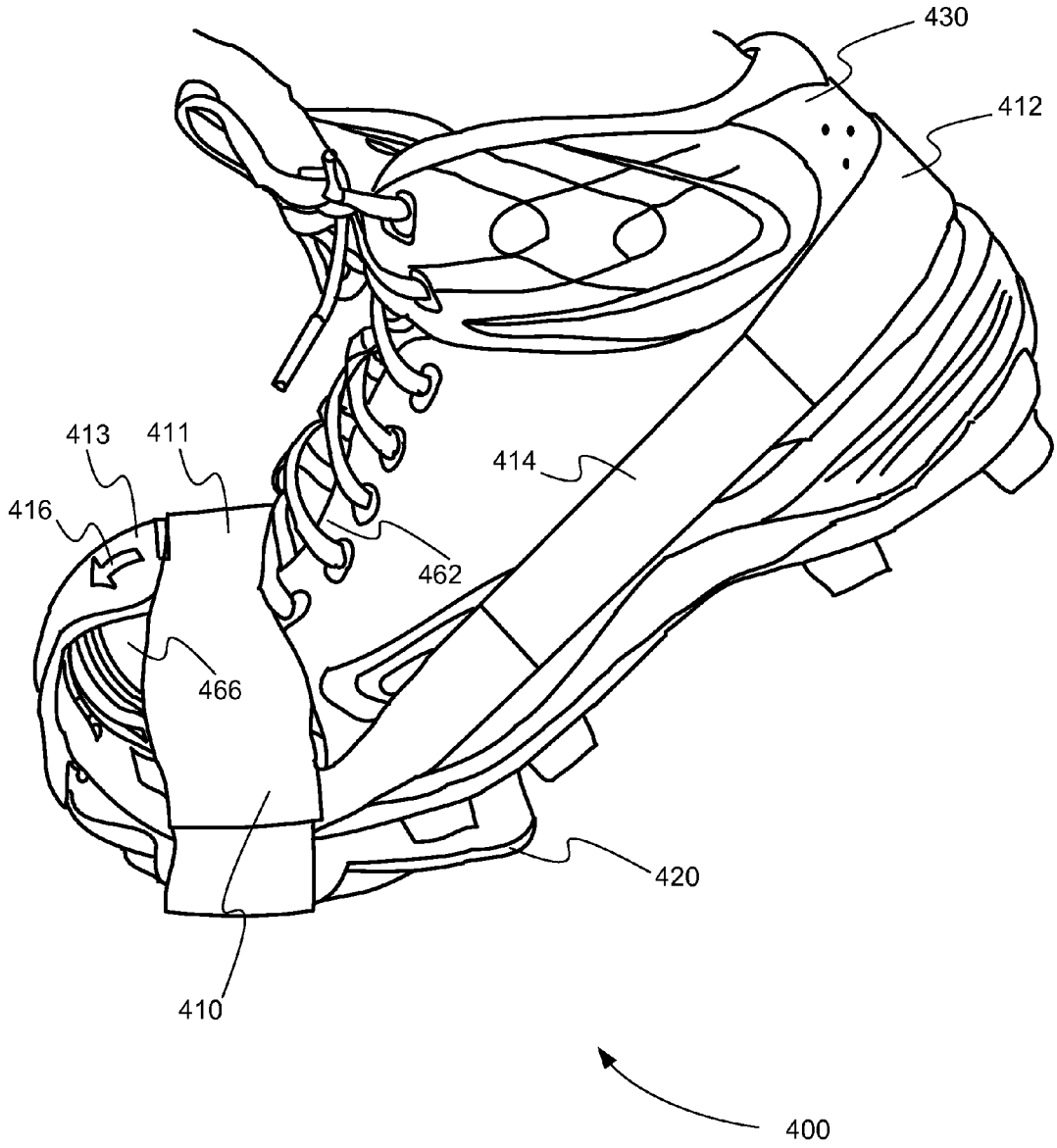
FIG. 4 is an side view of an enhanced wearable swing training apparatus that includes a shoe attachment device and a first plate of a rotation mechanism that is secured to a shoe, in accordance with various embodiments

FIG. 4 is a side view of an enhanced wearable swing training apparatus 400 that includes a shoe attachment device 410 and a first plate 420 of a rotation mechanism that is secured to a shoe 430, in accordance with various embodiments. Three straps of shoe attachment device 410 are shown in FIG. 4 as an example. One skilled in the art will appreciate that a different number of straps may be used. The straps of shoe attachment device 410 can be made of any material including, but not limited to, cloth, nylon, rubber, or leather. The straps of shoe attachment device 410 can be opened, closed, and tightened. The straps of shoe attachment device 410 are preferably opened, closed, and tightened using Velcro.

First strap 411 goes directly across the top of the toe portion of shoe 430. First strap 411 is secured to first plate 420 in eyelets on either side of shoe 430.

Second strap 412 wraps around the heel of shoe 430. Second strap 412 is connected or sewn to first strap 411 on either side of shoe 430. Second strap 412 preferably includes expandable portion 414. Expandable portion 414 is a piece of elastic material, for example.

Third strap 413 secures the front portion of shoe 430 to first plate 420 of rotation mechanism. Third strap 413 is secured to first plate 420 of rotation mechanism through an eyelet in the front portion of first plate 420 of rotation mechanism. The other end of strap 413 is connected, buckled, or sewn to the center portion of first strap 411. Third strap 413 includes a visual cue for determining the angular rotation of shoe 430. The visual cue is preferably an arrow 416 shown on a top portion of third strap 413. Arrow 416 is sewn or painted on third strap 413, for example.

In various embodiments, straps 411, 412, and 413 may be dark colored, such as in black, whereas arrow 416 may be light colored, such as white. However, one skilled in the art will appreciate that different combinations of colors may be used for straps 412,412, and 413 and arrow 416.

Figure 5:
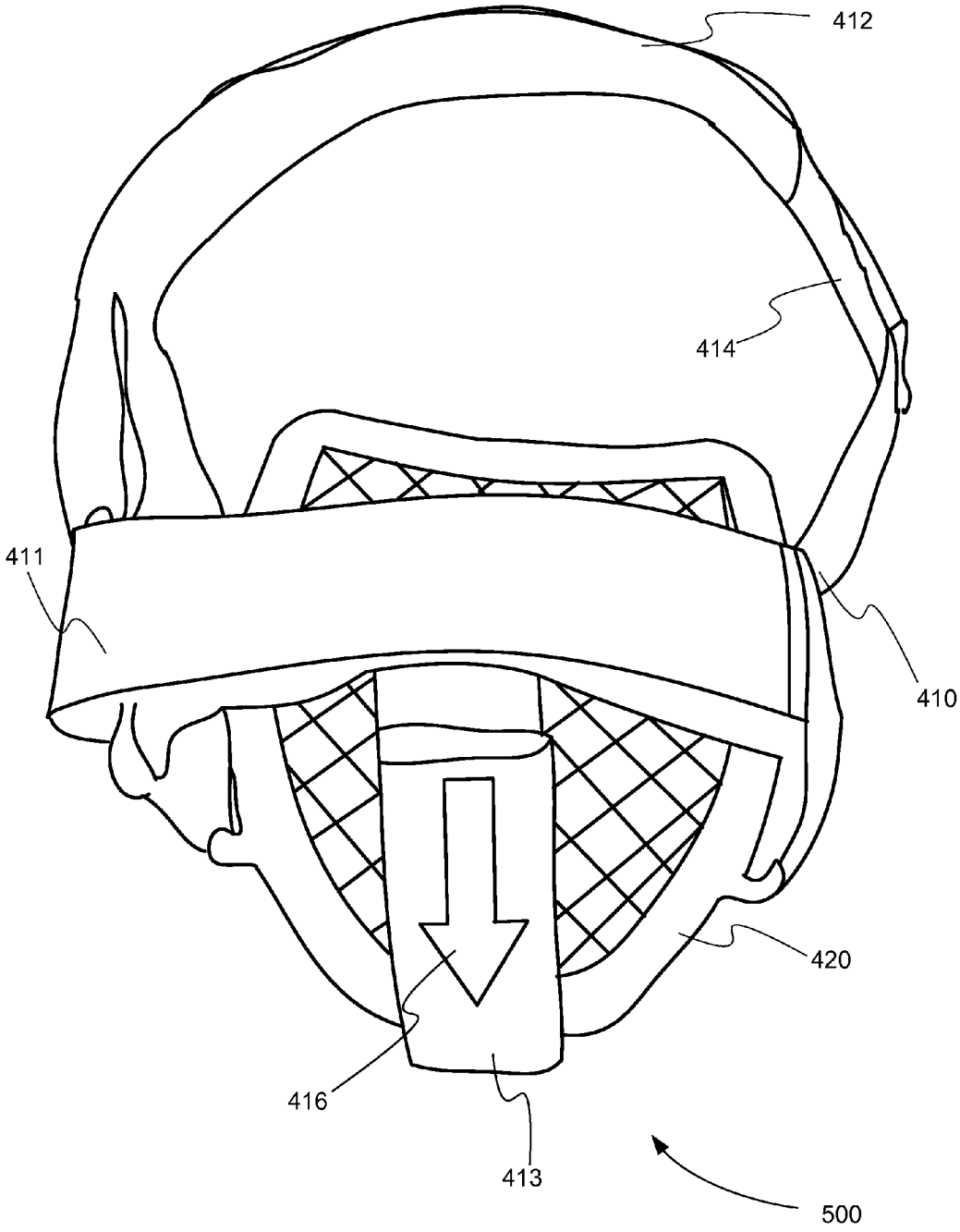
FIG. 5 is a top plan view of an enhanced wearable swing training apparatus, in accordance with various embodiments.

FIG. 5 is a top plan view of an enhanced wearable swing training apparatus 500, in accordance with various embodiments. Enhanced wearable swing training apparatus 500 includes shoe attachment device 410 and rotation mechanism that includes first plate 420. Shoe attachment device 410 includes straps 411, 412, and 413. Second strap 412 includes expandable portion 414. Second strap 412 is connected or sewn to first strap 411 on one side and looped through a buckle or eyelet connected to first strap 411 on the other side. Third strap 413 includes arrow 416.

Figure 6:
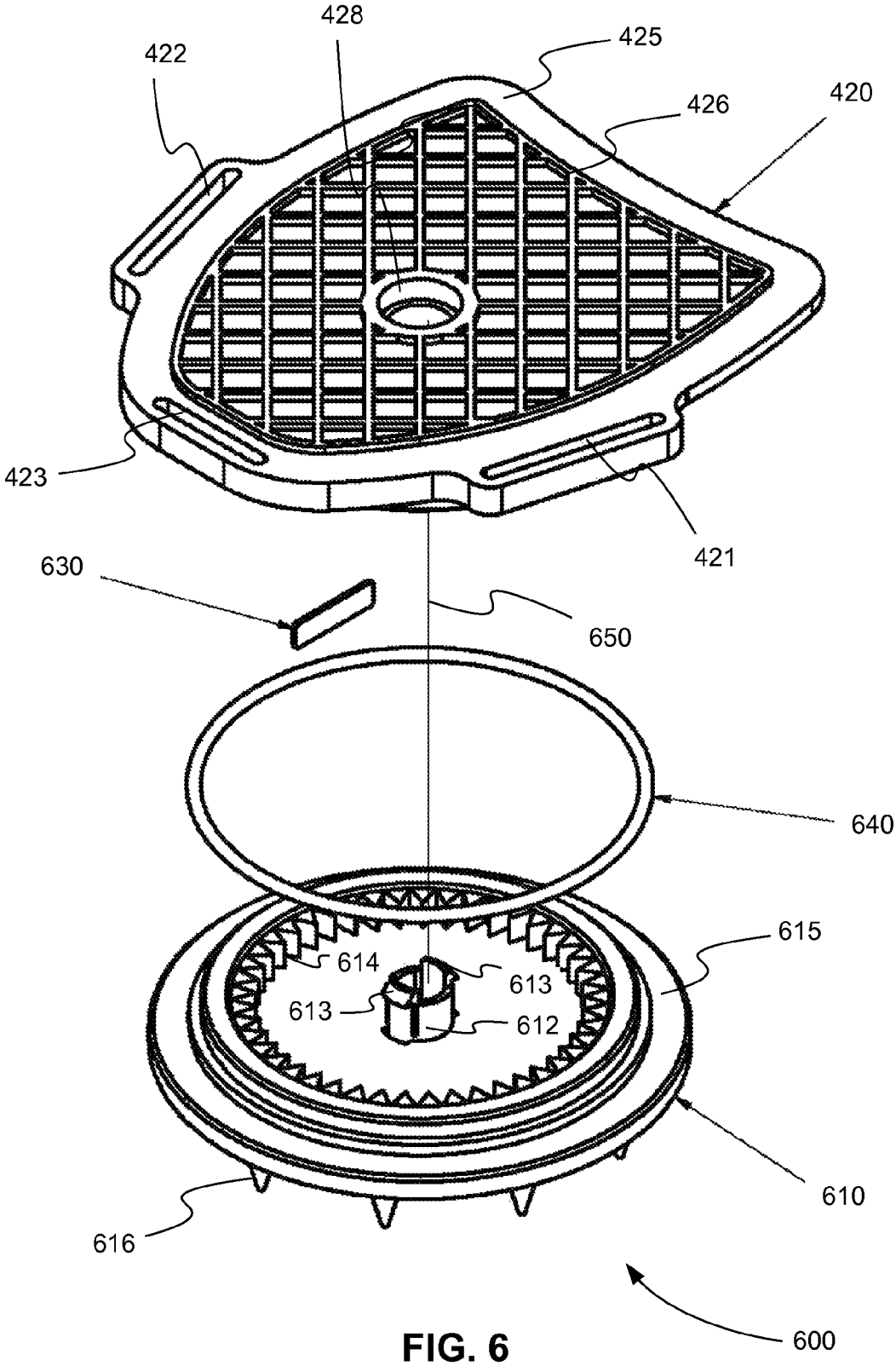
FIG. 6 is a top and exploded view of a rotation mechanism fan enhanced wearable swing training apparatus, in accordance with various embodiments.

FIG. 6 is a top and exploded view of a rotation mechanism 600 of an enhanced wearable swing training apparatus, in accordance with various embodiments. Rotation mechanism 600 includes first plate 420, second plate 610, clicker or paddle 630, and o-ring 640.

Top portion 425 of first plate 420 includes eyelets 421, 422, and 423. Eyelets 421 and 422 are used to secure first strap 411 of FIGS. 4 and 5 to first plate 420. Eyelets 421 and 422 are positioned on either side of first plate 420 to position first strap 411 of FIGS. 4 and 5 so that the edge of first strap 411 of FIGS. 4 and 5 closest to the heel of a shoe intersects or comes close to intersecting the axis of rotation 650 of rotation mechanism 600. Eyelet 423 is used to secure one end of third strap 413 of FIGS. 4 and 5 to first plate 420.

Top portion 425 of first plate 420 preferably includes a pattern 426. Pattern 426 is shown in FIG. 6 as a raised cross-hatched pattern. Pattern 426 can be, however, any design raised or sunken used to grip the bottom of a user's shoe to top portion 425 of first plate 420.

Top portion 425 of first plate 420 also includes a hole 428. Hole 428 receives post 612 of second plate 610. The connection of hole 428 to post 612 secures first plate 420 to second plate 610 and allows the rotation of first plate 420 with respect to second plate 610. Post 612, for example, includes movable hooks 613 that engage an edge of hole 428 to prevent first plate 420 and second plate 610 from coming apart.

In various embodiments, post 612 includes a fixed or adjustable notch (not shown) parallel to post 612. A flange (not shown) in hole 428 can move within the notch to limit the rotation of first plate 420 with respect to second plate 610 to a specific angle. This is one embodiment of a fixed or adjustable stop mechanism.

Top portion 425 of first plate 420 is preferably formed in the shape of a sole of a shoe. Top portion 425 of first plate 420 can come in different sizes for different size shoes.

Bottom portion (not shown) of first plate 420 includes one or more slots for holding one or more clickers or paddles 630. As first plate 420 rotates with respect to second plate 610, one or more clickers 630 engage teeth 614 of inner edge of top portion 615 of second plate 610. As one or more clickers 630 engage teeth 614, they emit a sound providing audio feedback to a user as to the rotation of first plate 420 with respect to second plate 610. One or more clickers 630 are made of a flexible material, for example. First plate 420 and second plate 610 can be made of any rigid material. First plate 420 and second plate 610 are made of acetol, for example.

O-ring 640 fills the gap between the bottom outer edge of first plate 420 and the upper outer edge of second plate 610. O-ring 640 is used, for example, to prevent dirt from getting between first plate 420 and second plate 610 and affecting the rotation of first plate 420 with respect to second plate 610.

Bottom portion of second plate 610 preferably includes spikes 616 for securing second plate 610 to the ground. In various embodiments, bottom portion of second plate 610 can include any type of surface including a flat surface, for example.

Figure 7:
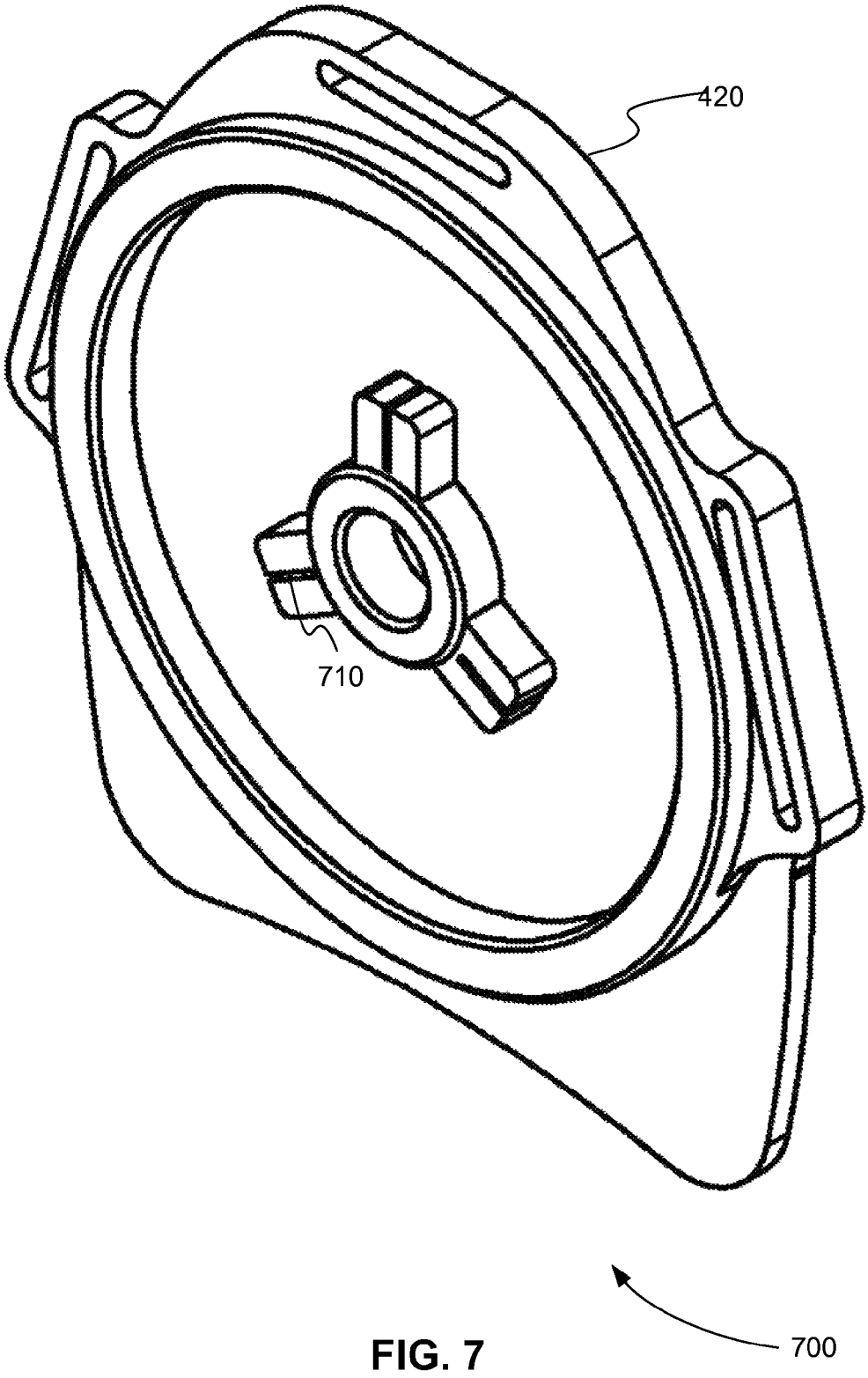
FIG. 7 is a perspective view of a bottom portion of first plate of an enhanced wearable swing training apparatus, in accordance with various embodiments.

FIG. 7 is a perspective view of a bottom portion 700 of first plate 420 of an enhanced wearable swing training apparatus, in accordance with various embodiments. Bottom portion 700 of first plate 420 includes one or more slots 710 for holding one or more clicker 630 of FIG. 6, which are used to provide audio feedback. FIG. 7 shows three radial slots 710.

Figure 8:
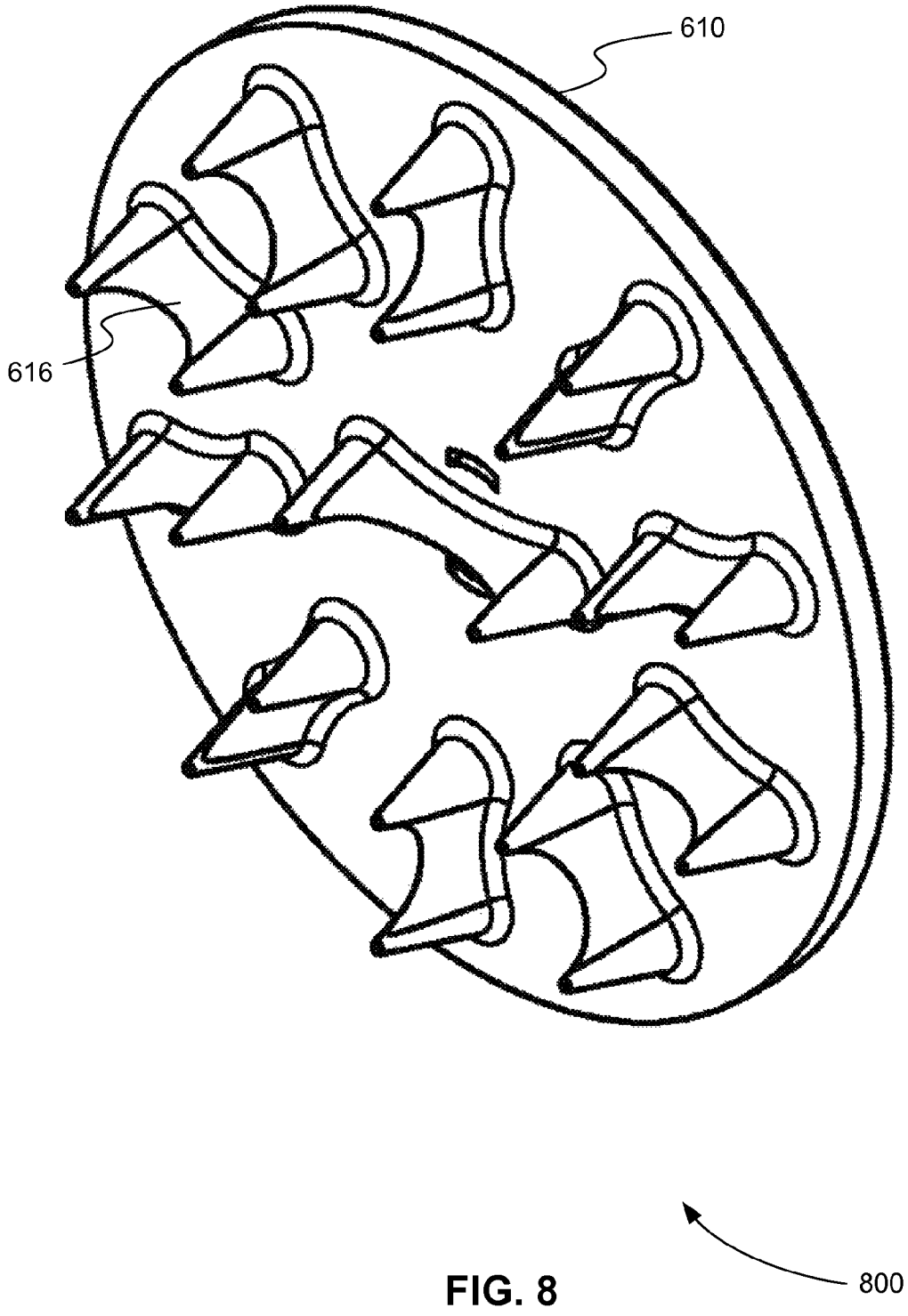
FIG. 8 is a perspective view of a bottom portion of second plate of an enhanced wearable swing training apparatus, in accordance with various embodiments.

FIG. 8 is a perspective view of a bottom portion 800 of second plate 610 of an enhanced wearable swing training apparatus, in accordance with various embodiments. Bottom portion 800 of second plate 610 includes a plurality of spikes 616. Spikes 616 include a variable height for penetrating non-uniform surfaces. Spikes 616 are positioned radially to oppose the angular force exerted by the rotation of first plate 420 of FIG. 6 with respect to second plate 610.

Figure 9:
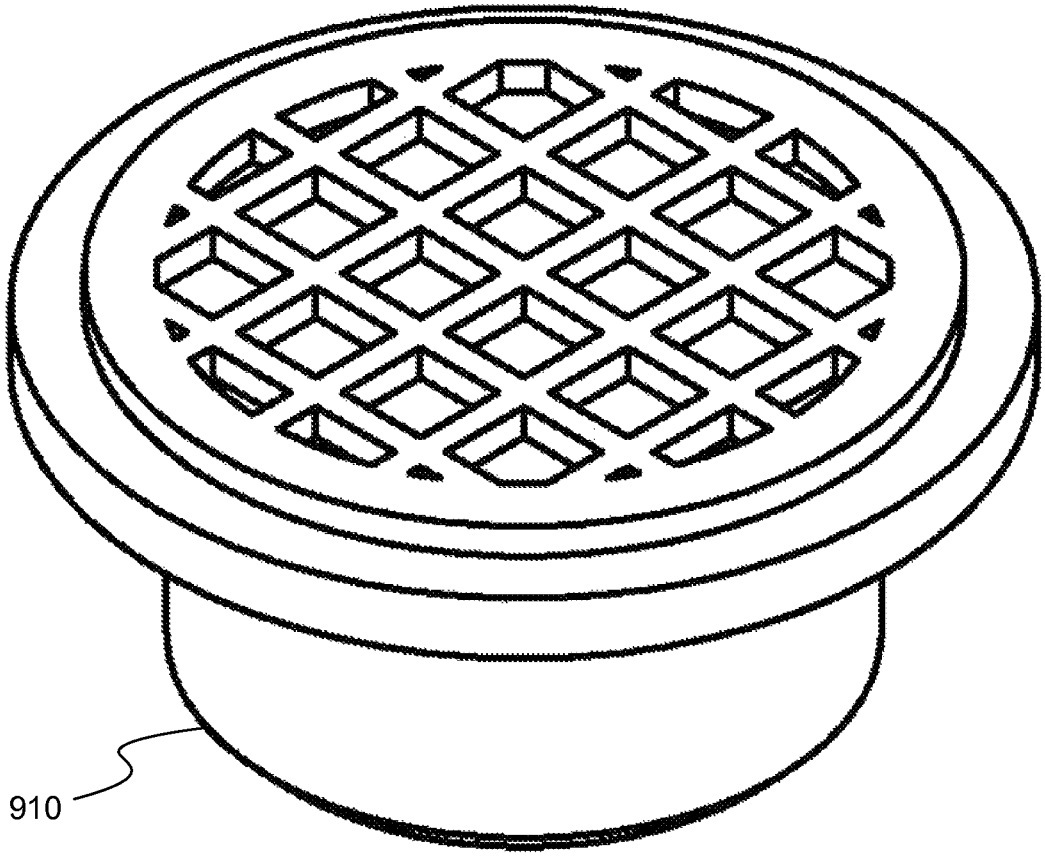
FIG. 9 is a perspective view of a disassembly tool, in accordance with various embodiments.

FIG. 9 is a perspective view of a disassembly tool 900, in accordance with various embodiments. Disassembly tool 900 is used to disassemble first plate 420 from second plate 610 of FIG. 6. Lower end 910 of disassembly tool 900 is inserted into hole 428 of FIG. 6, for example. Lower end 910 of disassembly tool 900 then moves movable hooks 613 of FIG. 6 disengaging an edge of hole 428 of FIG. 6 and allowing first plate 420 and second plate 610 of FIG. 6 to be moved apart.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

What is claimed is:

1. A swing training apparatus, comprising:

a rotation mechanism that includes a first plate connected to a second plate so that the first plate rotates with respect to the second plate about a shared plate axis of rotation; and a wearable shoe attachment device that is connected to the first plate and that positions a shoe of an athlete so that as the athlete rotates a foot and the shoe enclosing the foot with respect to a part of the foot and about a foot axis of rotation, the foot axis of rotation and the plate axis of rotation coincide, connects to the first plate so that the swing training apparatus moves with the foot while walking or running, and includes a first strap secured perpendicularly over a toe portion of the shoe and fastened to the first plate, a second strap surrounding a heel of the shoe and fastened to the first strap on either side of the shoe, and a third strap secured parallelly over the toe portion of the shoe and fastened to the first plate and a center of the first strap.

2. The apparatus of claim 1, further comprising an audio feedback mechanism connected between the first plate and the second plate that emits a sound as the angle of rotation between the first plate and the second plate is increased.

3. The apparatus of claim 2, wherein the audio feedback mechanism includes one or more slots on a bottom side of the first plate that accept one or more clickers or paddles that engage teeth displaced along an inner edge of the second plate.

4. The apparatus of claim 1, further comprising a visual feedback mechanism.

5. The apparatus of claim 4, wherein the visual feedback mechanism includes an arrow placed on a top portion of the third strap that points in the direction of the shoe.

6. The apparatus of claim 1, further comprising an expandable portion in the second strap that prevents any gapping in the second strap and maintains a secure fit to the shoe as the foot is rotated or while walking or running.

7. The apparatus of claim 1, wherein the first strap is connected to the first plate so that an edge of the first strap closest to the heel of the shoe intersects or comes close to intersecting the plate axis of rotation.

8. The apparatus of claim 1, wherein the first strap, the second strap, and the third strap include Velcro for opening, closing, and tightening.

9. A swing training apparatus, comprising:

a rotation mechanism that includes a first plate connected to a second plate so that the first plate rotates with respect to the second plate about a shared plate axis of rotation and an audio feedback mechanism connected between the first plate and the second plate that emits a sound as the angle of rotation between the first plate and the second plate is increased; and a wearable shoe attachment device that is connected to the first plate and that positions a shoe of an athlete so that as the athlete rotates a foot and the shoe enclosing the foot with respect to a part of the foot and about a foot axis of rotation, the foot axis of rotation and the plate axis of rotation coincide, and connects to the first plate so that the swing training apparatus moves with the foot while walking or running.

10. The apparatus of claim 9, wherein the audio feedback mechanism includes one or more slots on a bottom side of the first plate that accept one or more clickers or paddles that engage teeth displaced along an inner edge of the second plate.

11. The apparatus of claim 9, wherein the first plate and the second plate are secure by moveable hooks on a post of the second plate that engages an edge of a hole of the first plate.

12. The apparatus of claim 11, further comprising a disassembly tool that is inserted into the hole and disengages the moveable hooks from the edge of hole allowing the first plate and the second plate to be moved apart.

13. The apparatus of claim 9, further comprising an o-ring to fill a gap between the first plate and the second plate.

14. The apparatus of claim 9, wherein the first plate includes one or more eyelets for securing the wearable shoe attachment device to the first plate.

15. The apparatus of claim 9, wherein the first plate includes a pattern to grip the shoe.

16. The apparatus of claim 9, wherein a side of the second plate opposite a side engaging the first plate includes one or more spikes for gripping a playing surface.

17. The apparatus of claim 9, wherein the first plate includes a surface that has a shape of a portion of a sole of a shoe.

18. A swing training apparatus, comprising:

a rotation mechanism that includes a first plate connected to a second plate so that the first plate rotates with respect to the second plate about a shared plate axis of rotation and a stop mechanism for limiting an angle of rotation about the shared plate axis of rotation; and a wearable shoe attachment device that is connected to the first plate and that positions a shoe of an athlete so that as the athlete rotates a foot and the shoe enclosing the foot with respect to a part of the foot and about a foot axis of rotation, the foot axis of rotation and the plate axis of rotation coincide, and connects to the first plate so that the swing training apparatus moves with the foot while walking or running.

19. The swing training apparatus of claim 18, wherein the stop mechanism is adjustable.

20. The swing training apparatus of claim 19, wherein the second plate includes a fixed angle of rotation and the stop mechanism is adjusted by changing the second plate.

* * * * *